US008246374B1

(12) United States Patent
Zhou

(10) Patent No.: US 8,246,374 B1
(45) Date of Patent: Aug. 21, 2012

(54) CONNECTOR ASSEMBLY WITH CONNECTOR HAVING ELECTRICAL SPRING PLATE

(75) Inventor: Hai-Qing Zhou, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/221,841

(22) Filed: Aug. 30, 2011

(30) Foreign Application Priority Data

Jul. 5, 2011 (CN) ..... 2011 1 0185961

(51) Int. Cl.
*H01R 13/627* (2006.01)

(52) U.S. Cl. ..... 439/358

(58) Field of Classification Search ..... 439/358, 439/78

See application file for complete search history.

(56) References Cited

U.S. PATENT DOCUMENTS 3,753,212 A * 8/1973 Yamada et al. ..... 439/358
6,491,538 B2 * 12/2002 Fenger ..... 439/358
6,503,108 B1 * 1/2003 Kikuchi et al. ..... 439/680
6,786,740 B2 * 9/2004 Ito ..... 439/76.2
6,935,902 B1 * 8/2005 Chou ..... 439/701
7,094,109 B2 * 8/2006 Chou ..... 439/651
7,294,009 B1 * 11/2007 Peng et al. ..... 439/326
7,491,095 B1 * 2/2009 Huang ..... 439/682
7,641,518 B2 * 1/2010 Lee et al. ..... 439/660
7,780,481 B2 * 8/2010 Chen et al. ..... 439/717
7,806,733 B2 * 10/2010 Lee et al. ..... 439/660
2003/0139082 A1 * 7/2003 Aramoto et al. ..... 439/358
2005/0208837 A1 * 9/2005 Chou ..... 439/651
2006/0205282 A1 * 9/2006 Chou ..... 439/651
2007/0212944 A1 * 9/2007 Sun ..... 439/660
2008/0076277 A1 * 3/2008 Chen et al. ..... 439/78
2008/0139022 A1 * 6/2008 Chen et al. ..... 439/101
2008/0166900 A1 * 7/2008 Chang ..... 439/76.1
2008/0274631 A1 * 11/2008 Lee et al. ..... 439/78
2009/0298313 A1 * 12/2009 Lee et al. ..... 439/78
2010/0151749 A1 * 6/2010 Po ..... 439/884
2011/0250787 A1 * 10/2011 Kan et al. ..... 439/527

* cited by examiner

*Primary Examiner* — Amy Cohen Johnson
*Assistant Examiner* — Vladimir Imas
(74) *Attorney, Agent, or Firm* — Altis Law Group, Inc.

(57) ABSTRACT

A connector assembly for electrically connecting a hard disk to a motherboard includes a first connector and a second connector positioned on the motherboard. The first connector includes a first insulation main body, a plurality of electrical pins arranged in the first insulation main body, and a locking member positioned on the first insulation main body. The second connector includes a second insulation main body, a plurality of electrical spring plates arranged in the second insulation main body, and a protruding locking block arranged on the second insulation main body and engaged with the locking member.

17 Claims, 3 Drawing Sheets

CONNECTOR ASSEMBLY WITH CONNECTOR HAVING ELECTRICAL SPRING PLATE

BACKGROUND

1. Technical Field

The present disclosure relates to connector assemblies, and particularly, to a connector assembly for electrically connecting a hard disk to a motherboard.

2. Description of Related Art

Hard disk drives are one of the main elements of computers, and need a connector assembly (e.g. male connector and female connector) to be electrically coupled to the motherboard.

However, after a substantial number of connect and disconnect cycles, the connection between the male connector and the female connector becomes very loose, and the integrity of the electrical connection can be reduced, causing non-recognition of, and other malfunctions in, the hard disk.

Therefore, what is needed is a new connector assembly that can overcome the described limitations.

DETAILED DESCRIPTION

The embodiments will now be described in detail with reference to the drawings.

Figure 1:
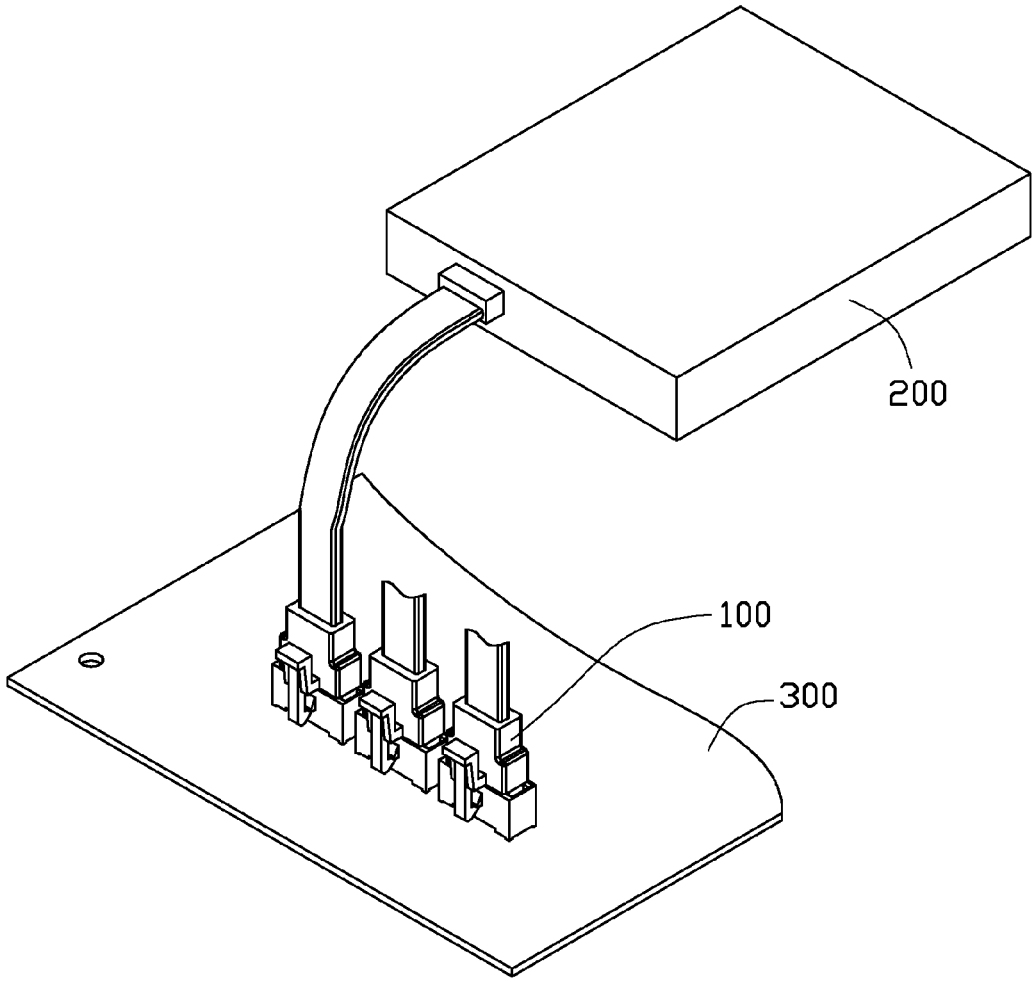
FIG. 1 is an isometric view of a connector assembly according to an exemplary embodiment.
Figure 2:
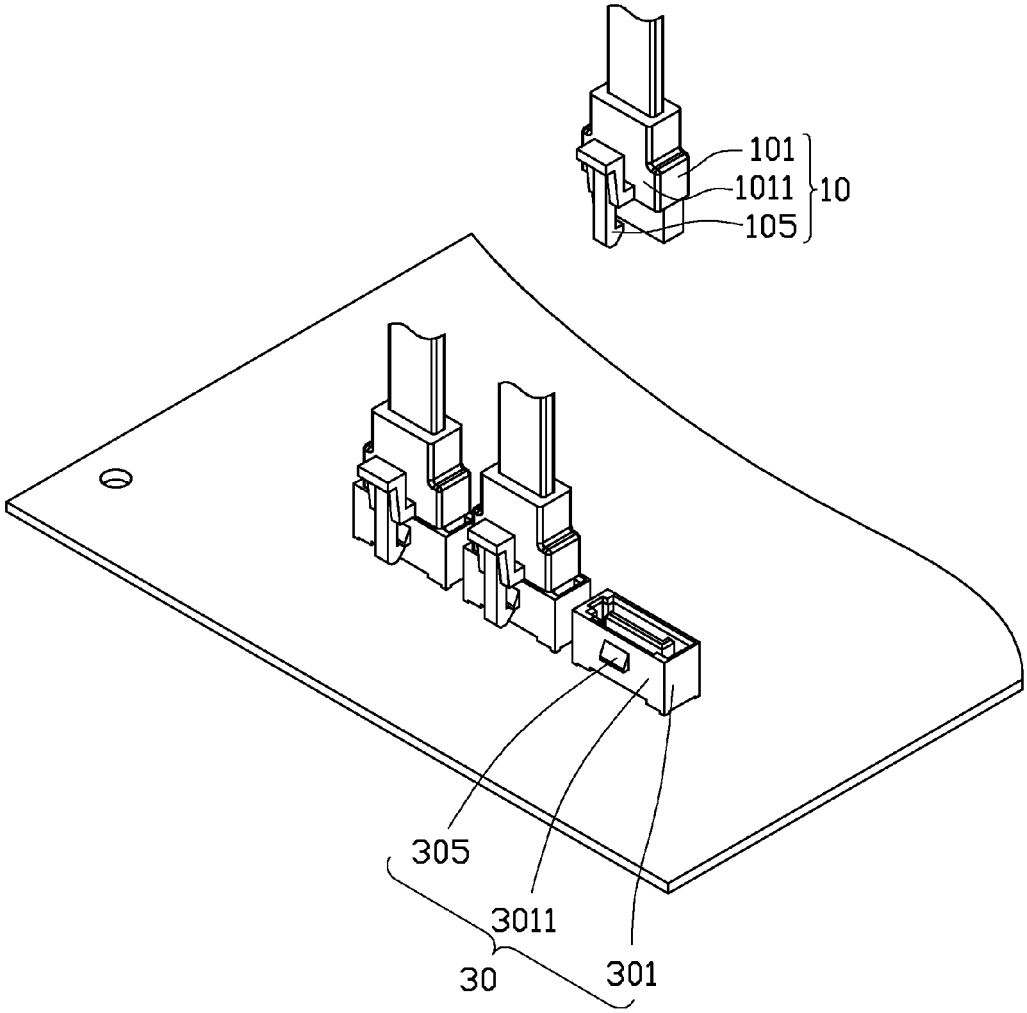
FIG. 2 is an exploded isometric view of the connector assembly of FIG. 1.
Figure 3:
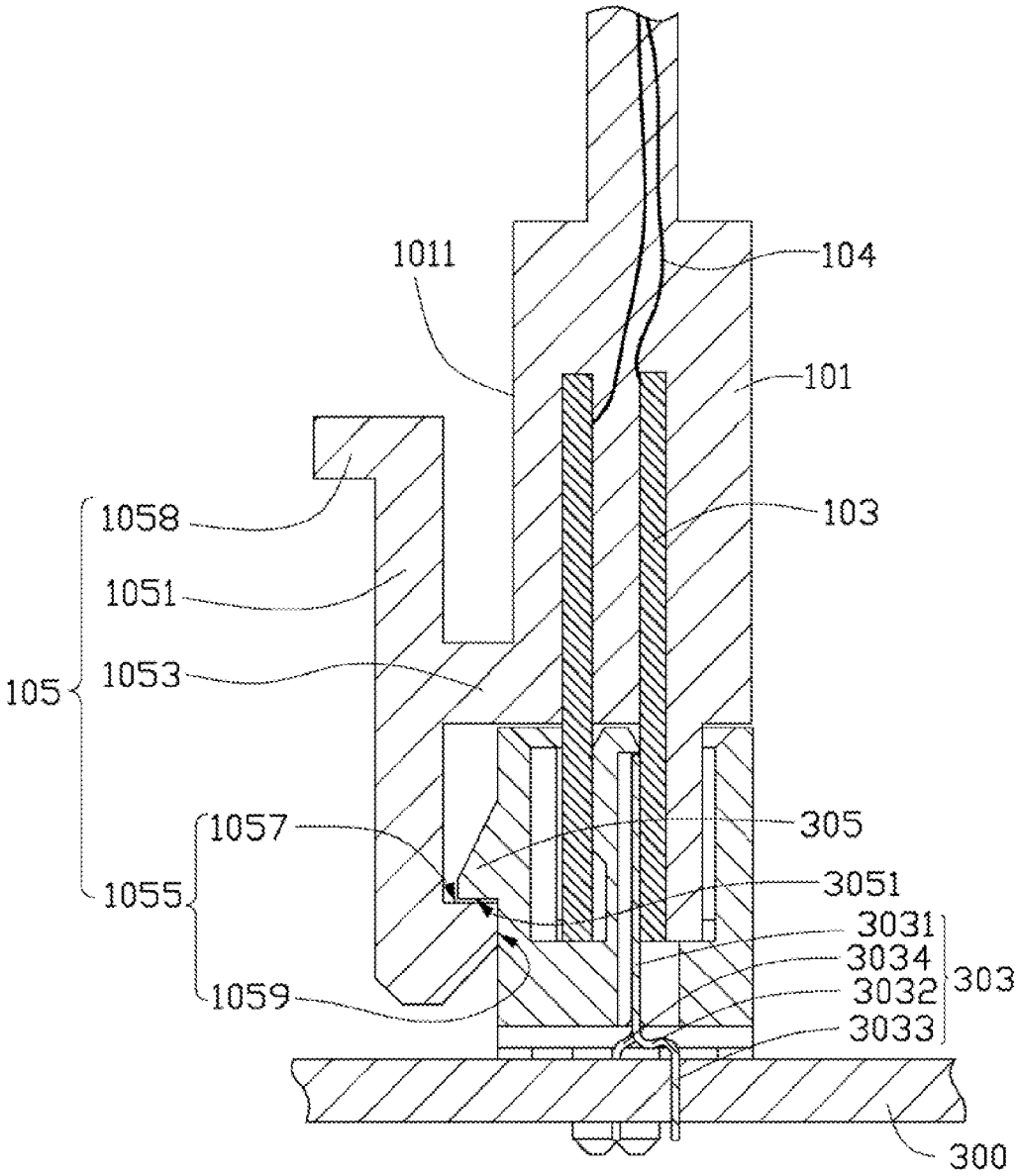
FIG. 3 is a sectional view of the connector assembly of FIG. 1.

Referring to FIGS. 1, 2, and 3, a connector assembly 100, in accordance with an exemplary embodiment, is shown. The connector assembly 100 is configured for electrically connecting a hard disk drive (hard disk 200) to a motherboard 300.

The connector assembly 100 includes a first connector 10 electrically coupled to the hard disk 200, and a second connector 30 arranged on the motherboard 300 and electrically coupled to the first connector 10.

The first connector 10 includes a first insulation main body 101, a plurality of electrical pins 103 arranged in the first insulation main body 101, a locking member 105 positioned lengthwise on a lateral surface 1011 of the first insulation main body 101. The electrical pins 103 are electrically coupled to the hard disk 200 via a plurality of electrical wires 104.

The locking member 105 includes a main portion 1051, a connection portion 1053 connected between the main portion 1051 and the lateral surface 1011, and a stop portion 1055.

The main portion 1051 is a bar-shaped structure operating like a teeterboard, and when at rest is parallel with the first insulation main body 101.

The connection portion 1053 is a fulcrum, and is perpendicular to the lateral surface 1011. The two ends of the connection portion 1053 are respectively connected to a middle of the main portion 1051 and the first insulation main body 101, such that the main portion 1051 is connected to the first insulation main body 101. In other embodiments, the connection portion 1053 may be other than perpendicular to the lateral surface 1011.

The stop portion 1055 extends from a first end of the main portion 1051 adjacent to the motherboard 300, towards the first insulation main body 101. The stop portion 1055 is configured for locking the first connector 10 onto the second connector 30. The stop portion 1055 includes a first abutting surface 1057 facing the connection portion 1053, and a second abutting surface 1059 adjacent to the first abutting surface 1057. In the present embodiment, the first abutting surface 1057 is perpendicular to the main portion 1051, and the second abutting surface 1059 is perpendicular to the first abutting surface 1057. In other embodiments, and subject to the limits of effectiveness, the first abutting surface 1057 may be other than perpendicular to the main portion 1051, and the second abutting surface 1059 may be other than perpendicular to the first abutting surface 1057.

The second connector 30 is fixed on and electrically coupled to the mother board 300. The second connector 30 includes a second insulation main body 301, a plurality of electrical spring plates 303 partially embedded in the second insulation main body 301, and a protruding locking block 305 arranged on a side surface 3011 of the second insulation main body 301.

The electrical spring plates 303 are electrically coupled to the motherboard 300. Each one of the electrical spring plates 303 connects with a respective one of the electrical pins 103 when the first and second connectors 10, 30 are coupled with each other, such that the hard disk 200 is correctly coupled electrically to the motherboard 300. Each one of the electrical spring plates 303 includes a contacting portion 3031, a connection portion 3032, a fixing portion 3033, and an electrical connection portion 3034. The contacting portion 3031 contacts and is electrically coupled to a corresponding one of the electrical pins 103. The connection portion 3032 is substantially parallel to the motherboard 300, and is configured for connecting the contacting portion 3031 and the fixing portion 3033. The fixing portion 3033 stands on the motherboard 300 and extends perpendicularly though the motherboard 300 to fix the electrical spring plate 303 to the motherboard 300. The electrical connection portion 3034 extends through the motherboard 300 and is electrically coupled to a contact at a rear surface of the motherboard 300, to enable the hard disk 200 to communicate with the motherboard 300.

The protruding locking block 305 protrudes from the side surface 3011 and is intended to be engaged by, and to lock in place, the main portion 1051. The protruding locking block 305 includes a third abutting surface 3051 which allows the locking member 105 to function as a latch. In the present embodiment, the third abutting surface 3051 is perpendicular to the side surface 3011. In other embodiments, the third abutting surface 3051 may be other than perpendicular to the side surface 3011.

When the first connector 10 is inserted into the second connector 30, the protruding locking block 305 is securely locked to the locking member 105 with the third abutting surface 3051 contacting the first abutting surface 1057 and the second abutting surface 1059 contacting the side surface 3011, such that the first connector 10 is securely connected to the second connector 30.

For conveniently separating the first connector 10 from the second connector 10, the locking member 105 also includes a pressing portion 1058. The pressing portion 1058 extends from a second end of the main portion 1051 in a direction away from the first insulation main body 101. The pressing portion 1058 is positioned away from the second connector 30. When the pressing portion 1058 is pressed toward the first connector 10 with finger pressure, the stop portion 1055 is separated from the protruding locking block 305, such that the first connector 10 is easily separated from the second connector 30.

In the present embodiment, the protruding locking block 305 engages with the locking member 105, such that each of the electrical pins 103 is in complete contact with its correct electrical spring plate 303 of the electrical spring plates 303. Accordingly, the electrical connection between the hard disk 200 and the motherboard 300 is more reliable and stable, and non-recognition or other problems with the hard disk 200 are avoided.

While certain embodiments have been described and exemplified above, various other embodiments will be apparent from the foregoing disclosure to those skilled in the art. The disclosure is not limited to the particular embodiments described and exemplified but is capable of considerable variation and modification without departure from the scope and spirit of the appended claims.

What is claimed is:

1. A connector assembly for electrically connecting a hard disk to a motherboard, comprising:

a first connector, the first connector comprising a first insulation main body, a plurality of electrical pins arranged in the first insulation main body, and a locking member positioned on the first insulation main body, the electrical pins provided for being electrically coupled to the hard disk; and a second connector arranged on the motherboard, the second connector comprising a second insulation main body, a plurality of electrical spring plates arranged in the second insulation main body, and a protruding locking block arranged on the second insulation main body and configured to engage with the locking member, the electrical spring plates provided for being electrically coupled to the motherboard, each one of the electrical spring plates contacting a respective one of the electrical pins when the first and second connectors are coupled with each other, such that the hard disk is electrically coupled to the motherboard;

wherein each electrical spring plate comprises a contacting portion, a connection portion, and a fixing portion, the contacting portion contacts and is electrically coupled to a corresponding one of the electrical pins, the connection portion is substantially parallel to the motherboard and interconnects the contacting portion and the fixing portion, and the fixing portion stands on the motherboard and extends perpendicularly though the motherboard to fix the electrical spring plate to the motherboard.

2. The connector assembly of claim 1, wherein the locking member comprises a main portion, a connection portion connected between the main portion and the first insulation main body, and a stop portion, and the stop portion engages with the protruding locking block to lock the first connector onto the second connector when the first and second connectors are coupled with each other.

3. The connector assembly of claim 2, wherein the stop portion comprises a first abutting surface facing the protruding locking block, and a second abutting surface adjacent to the first abutting surface, the protruding locking block comprises a third abutting surface facing the stop portion, and the first abutting surface contacts the third abutting surface.

4. The connector assembly of claim 3, wherein the second insulation main body comprises a side surface, the protruding locking block is positioned on the side surface, the third abutting surface is perpendicular to the side surface, the first abutting surface is perpendicular to the main portion, and the third abutting surface faces away from the first insulation main body when the first and second connectors are coupled with each other.

5. The connector assembly of claim 2, wherein the main portion is bar-shaped, and is parallel with the first insulation main body when at rest.

6. The connector assembly of claim 5, wherein the connection portion is a fulcrum, and two ends of the connection portion are respectively connected with the main portion and the first insulation main body.

7. The connector assembly of claim 1, wherein each electrical spring plate further comprises an electrical connection portion branching from the contacting portion, and the electrical connection portion extends through the motherboard and is electrically coupled to a contact at a rear surface of the motherboard, to enable the hard disk to communicate with the motherboard.

8. The connector assembly of claim 7, wherein the electrical connection portion of the electrical spring plate is substantially parallel to the contact portion and the fixing portion.

9. The connector assembly of claim 1, wherein the first insulation main body of the first connector comprises two opposite long lateral surfaces and two opposite short lateral surfaces, the locking member is positioned lengthwise on one of the long lateral surfaces of the first insulation main body, and no locking member is positioned at the other one of the long lateral surfaces of the first insulation main body.

10. An apparatus comprising:

a hark disk, a motherboard and a plurality of connector assemblies;

wherein one of the connector assemblies is configured for electrically connecting the hard disk to the motherboard, and comprises a second connector arranged on the motherboard, and a first connector detachably coupled with the second connector;

the first connector comprises a first insulation main body and a plurality of electrical pins arranged in the first insulation main body, and the electrical pins are electrically coupled to the hard disk;

the second connector comprises a second insulation main body, and a plurality of electrical spring plates arranged in the second insulation main body, the electrical spring plates are electrically coupled to the motherboard, and each of the electrical spring plates contacts a respective one of the electrical pins when the first and second connectors are coupled with each other; and each electrical spring plate comprises a contacting portion, a connection portion, and a fixing portion, the contacting portion contacts and is electrically coupled to the respective one of the electrical pins, the connection portion is substantially parallel to the motherboard and interconnects the contacting portion and the fixing portion, and the fixing portion stands on the motherboard and extends perpendicularly though the motherboard to fix the electrical spring plate to the motherboard.

11. The apparatus of claim 10, wherein each electrical spring plate further comprises an electrical connection portion branching from the contacting portion, and the electrical connection portion extends through the motherboard and is electrically coupled to a contact at a rear surface of the motherboard, to enable the hard disk to communicate with the motherboard.

12. The apparatus of claim 11, wherein the electrical connection portion of the electrical spring plate is substantially parallel to the contact portion and the fixing portion.

13. The apparatus of claim 10, wherein the first connector further comprises a locking member positioned on the first insulation main body, and the second connector further comprises a protruding locking block arranged on the second insulation main body and configured to engage with the locking member.

14. The apparatus of claim 13, wherein the first insulation main body of the first connector comprises two opposite long lateral surfaces and two opposite short lateral surfaces, the locking member is positioned lengthwise on one of the long lateral surfaces of the first insulation main body, and no locking member is positioned at the other one of the long lateral surfaces of the first insulation main body.

15. The apparatus of claim 14, wherein the locking member comprises a main portion, a connection portion connected between the main portion and the first insulation main body, and a stop portion, and the stop portion engages with the protruding locking block to lock the first connector onto the second connector when the first and second connectors are coupled with each other.

16. The apparatus of claim 15, wherein the stop portion comprises a first abutting surface facing the protruding locking block, and a second abutting surface adjacent to the first abutting surface, the protruding locking block comprises a third abutting surface facing the stop portion, and the first abutting surface contacts the third abutting surface.

17. The apparatus of claim 16, wherein the second insulation main body comprises a side surface, the protruding locking block is positioned on the side surface, the third abutting surface is perpendicular to the side surface, the first abutting surface is perpendicular to the main portion, and the third abutting surface faces away from the first insulation main body when the first and second connectors are coupled with each other.

* * * * *